United States Patent [19]

Kraehn

[11] Patent Number: 4,990,964

[45] Date of Patent: Feb. 5, 1991

[54] TONER DELIVERY SYSTEM HAVING A MULTI-FUNCTIONAL TONER CONTAINER FOR NON-MECHANICAL PRINTER AND COPIER MEANS

[75] Inventor: Erich Kraehn, Karlsfeld, Fed. Rep. of Germany

[73] Assignee: Siemens Aktiengesellschaft, Berlin and Munich, Fed. Rep. of Germany

[21] Appl. No.: 348,668

[22] PCT Filed: Sep. 25, 1987

[86] PCT No.: PCT/DE87/00440

§ 371 Date: Mar. 24, 1989

§ 102(e) Date: Mar. 24, 1989

[87] PCT Pub. No.: WO88/02504

PCT Pub. Date: Apr. 7, 1988

[30] Foreign Application Priority Data

Oct. 2, 1986 [DE] Fed. Rep. of Germany ..... 3633606

[51] Int. Cl.[5] ..... G03G 15/06

[52] U.S. Cl. ..... 355/260; 222/DIG. 1

[58] Field of Search ..... 355/260, 298; 206/316.1, 829; 222/DIG. 1, 464

[56] References Cited

U.S. PATENT DOCUMENTS 1,416,347 5/1922 Gregory .
3,784,297 1/1974 Ito et al. .
3,858,763 1/1975 Mack ..... 222/464 X
3,883,240 5/1975 Ito et al. .
4,109,827 8/1978 Leonard, Jr. ..... 222/464 X
4,265,572 5/1981 Bourdois et al. .
4,274,455 6/1981 Simons .
4,289,092 9/1981 McChesney et al. ..... 355/260 X
4,465,112 8/1984 Kopp .
4,561,759 12/1985 Knott .

FOREIGN PATENT DOCUMENTS

WO85/00902 2/1985 Fed. Rep. of Germany .

*Primary Examiner*—A. T. Grimley
*Assistant Examiner*—Nestor R. Ramirez
*Attorney, Agent, or Firm*—Hill, Van Santen, Steadman & Simpson

[57] ABSTRACT

The toner container (10) described has a bottom in the shape of a funnel, with a very deep toner storage region. The side walls of the container consist of flat surfaces, whereby at least one wall (12) of the container forms a support surface for the toner container (10). In order to prevent the adhesion of the toner on the walls of the container, said walls are sloped. The toner container (10) is emptied by means of a vertically movable suction spout arranged in a vertically movable manner. In this way, it can be used both as a transfer tank for fresh toner and as a collection tank for used toner.

10 Claims, 6 Drawing Sheets

TONER DELIVERY SYSTEM HAVING A MULTI-FUNCTIONAL TONER CONTAINER FOR NON-MECHANICAL PRINTER AND COPIER MEANS

The invention is directed to a toner container and toner delivery system comprising a filling and emptying opening for interchangeable fastening in a holding mechanism of a printer or copier means.

BACKGROUND OF THE INVENTION

In copier and in modern fast data printers that operate on the principle of electrophotography, charge images are generated on a recording medium, for example directly on an intermediate carrier (photoconductive drum) or directly on special paper, and are subsequently inked with a black powder (toner) in a developer station. Given employment of an intermediate carrier, this toner image is subsequently transferred onto normal paper and fixed thereon.

As a rule, a two-component developer that is composed of ferromagnetic carrier particles and of the toner particles carrying the color is used. The developer is conducted past the charge image on the intermediate carrier with a magnetic brush arrangement, the toner adhering thereto as a result of electrostatic forces.

An electrophotographic copier means that develops charge images according to the principle addressed above is disclosed, for example, from DE-AS 21 66 667 and corresponding U.S. Pat. Nos. 3,784,297 and 3,883,240.

Due to the inking of the charge images on the intermediate carrier, the toner concentration in the developer mix of the developer station constantly decreases. It is therefore necessary to constantly supply new toner to the developer mix in metered fashion. Since the toner consumption per time unit is extremely high in fast copier means and high-performance data printers, a roomy, toner reservoir is used in such apparatus in order to avoid down time caused by refilling toner. When this toner reservoir is empty, the toner that is usually supplied in handy containers is filled into the reservoir. It is thereby important to fill the toner from the container into the reservoir such that no toner is spilled and thereby contaminates the environment.

German Patent No. 32 24 296 and corresponding U.S. Pat. No. 4,561,759 discloses an apparatus for filling and sieving toner from a container into a toner reservoir. The toner situated in a transport container, namely in a toner bottle, is thereby supplied to a reservoir in that the toner bottle is inverted into a filling aperture of the reservoir. A strainer basket that is closed from the reservoir with a sieve is arranged in the region of the filling aperture, this strainer basket being in communication with an electrical shaker means that can be triggered as needed. The shaker means is thereby triggered by opening the cover that closes the filling aperture.

In such filling devices, there is then the risk that the toner will be spilled given manual decanting from the toner bottle. Since, moreover, the toner is only supplied to the toner reservoir at a defined location, special distributor devices are needed in the toner reservoir in order to guarantee a uniform supply of the toner to the developer station.

Xerox Disclosure Journal, Vol. 1 No. 8, August 1976, p. 47, also discloses that toner be supplied to the developer station from a reservoir arranged at a distance therefrom in that air is blown through the reservoir. This air then transports the toner into the developer station.

DE-A-3 116 870 and corresponding U.S. Pat. No. 4,465,112 further discloses an apparatus for filling toner from a container into a reservoir in the development station of a non-mechanical printer or copier means. The apparatus is composed of a centering tank, of a seating surface and of a filling opening of the reservoir fashioned shaft-like. A swivel hole is arranged between the seating surface and the centering tank. The container is first arranged in the centering tank secured against turning. After being opened, the container is swivelled around the swivel hole until it comes to lie in the seating surface. The opening of the container thereby proceeds over the filling opening of the reservoir. The container is subsequently inverted into the filling opening.

SUMMARY OF THE INVENTION

It is an object of the invention to design a toner container of the species initially cited such that the toner can be decanted from this container into the printer or copier means in a simple way without compacted toner occurring or without the toner being spilled.

In a toner container of the species initially cited, this object is achieved by a toner container comprising a funnel-shaped floor that forms a lowest collecting region for the toner, a filling and emptying opening and collecting region of the toner container being arranged relative to one another such that the toner container is fastened in a holding mechanism in a removable position wherein the collecting region forms the lowest region of the toner container, a suction nozzle is allocated to the printer or copier device and is displaceable in the collecting region, and in that at least one container wall is fashioned as a supporting surface for the toner container.

Advantageous embodiments of the invention include all container walls fashioned as planar surfaces. The container walls have a wall slant in order to facilitate the flow of toner where the container sidewalls describe an angle of less than forty-five degrees with reference to a vertical axis of the container in the removal position. The toner delivery system includes a holding mechanism as a shaker mechanism. The holding mechanism is also fashioned swivelable for inserting the container into the printer means.

In the toner delivery system, the suction nozzle is arranged in a vertically displaceable fashion inside a flexible protecive sheath within a guide means arranged above the holding mechanism. The suction nozzle displaces itself along the holding mechanism in accordance with the level of the toner in the toner container during removal of the toner. Preferably, an adaptor connects the flexible protective sheath to a filling and emptying opening of the toner container in a dust-tight fashion and is provided between the guide means and the holding mechanism. A foil covers the filling the filling and emptying opening of the toner container in its filled condition and the adaptor includes a cutting means for penetrating the foil. The toner delivery system may also include a gripper element for gripping the toner container.

The toner container preferably has a closing cover arranged in captive fashion for the filling and emptying opening thereof.

In that the toner container comprises a funnel-shaped floor having a lowest collecting region for the toner, whereby at least one container wall serves as supporting surface for the container, the toner container can be completely emptied with the assistance of a suction nozzle. Via the supporting surface, the toner container can be placed on planar surfaces anywhere.

The wall slant of the side walls of the toner container prevents toner from emplacing itself on the side walls.

The collecting effect in the container can be further intensified via a shaker means.

The smooth wall surfaces of the toner container enable an easy stacking of the containers, this significantly facilitating the transport of a plurality of toner containers.

The multi-functional toner container of the invention is adapted such to the suction means for the toner with respect to its shaping that a contamination-free changing of the container is enabled for the operator of the printer means, whereby the toner container can be employed both as container for fresh toner as well as as a collecting container for used toner.

BRIEF DESCRIPTION OF THE DRAWINGS

Embodiments of the invention are shown in the drawings and shall be set forth in greater detail below by way of example. Shown are.

DESCRIPTION OF PREFERRED EMBODIMENTS

Figure 3:
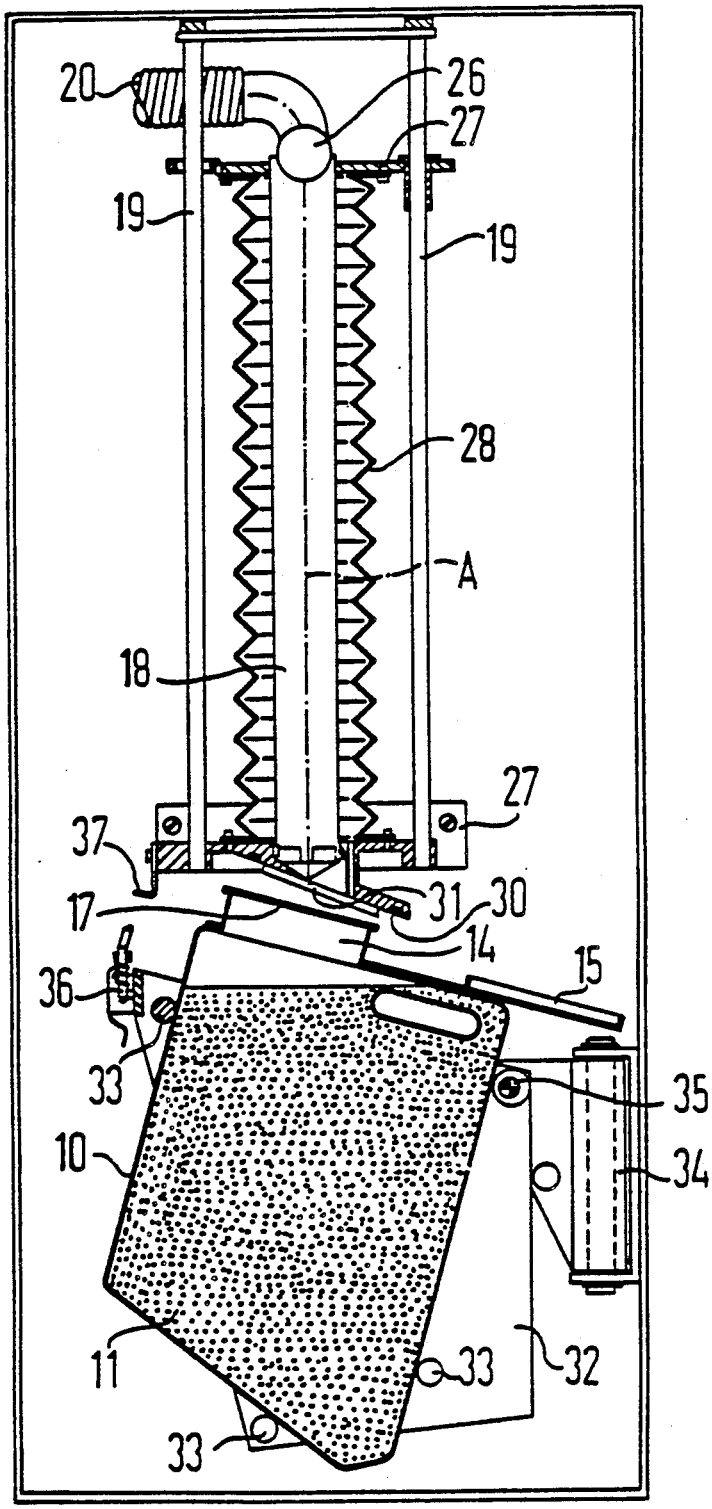
FIG. 3 a schematic illustration of the toner delivery region of a printer means with inserted, filled toner bottle before connection to the suction device.

A printer means that operates based on the electrophotographic principle and that is not shown in detail here contains a toner delivery region (FIG. 3) for the acceptance of a toner container 10 manufactured of plastic and having an appertaining draw-off means via which the powdery toner 11 is supplied to a developer station (not shown here) of the printer means. An emptying region (FIG. 8) is also provided in the printer means, an empty toner container 10 as collecting container for the developer mix being capable of being secured therein when emptying the developer station.

In a known way, a charge image is inked with toner in the developer station of the printer means via a two-component developer mix composed of toner and carrier particles. This developer mix, first, must be refreshed from time to time by adding toner; on the other hand, it is necessary after a longer operating time to replace the entire developer mix.

The toner container 10 is designed for the acceptance of about 3 kg of toner powder. Its container walls thereby form a planar surface, whereby one surface 12 is designed as supporting surface. The upper wall surfaces of the toner container form a cuboid having parallel surfaces, this enabling a space-saving stacking of the toner containers. A handle 13 is thereby arranged such integrated into the wall surfaces that, first, easy carrying of the toner container 10 is enabled and, second, a stacking of a plurality of toner containers is not impeded. Adjoining the supporting surface 13, the container walls 12/5 and 12/6 together with the container wall 12/1 and the supporting surface 12 form a funnel-shaped collecting region for the toner. A filling and emptying opening 14 is situated lying opposite this collecting region and can be closed with a cover 16 having an insert 9 of expanded material the cover 16 being captively secured via a clip 15.

After filling with toner powder 11, the opening itself is sealed with an aluminum foil 17.

Figure 1:
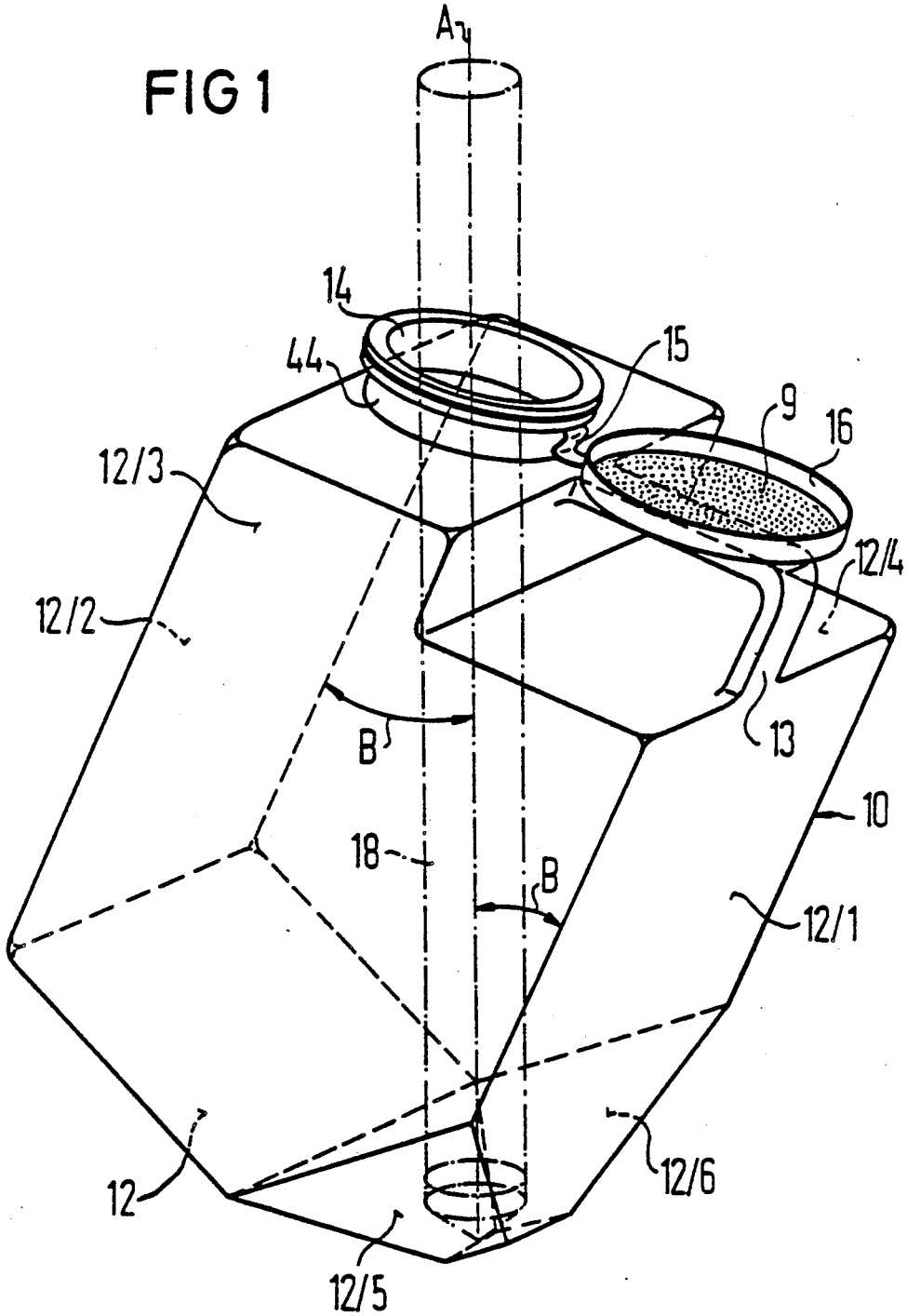
FIG. 1 a schematic illustration of the toner container.
Figure 2:
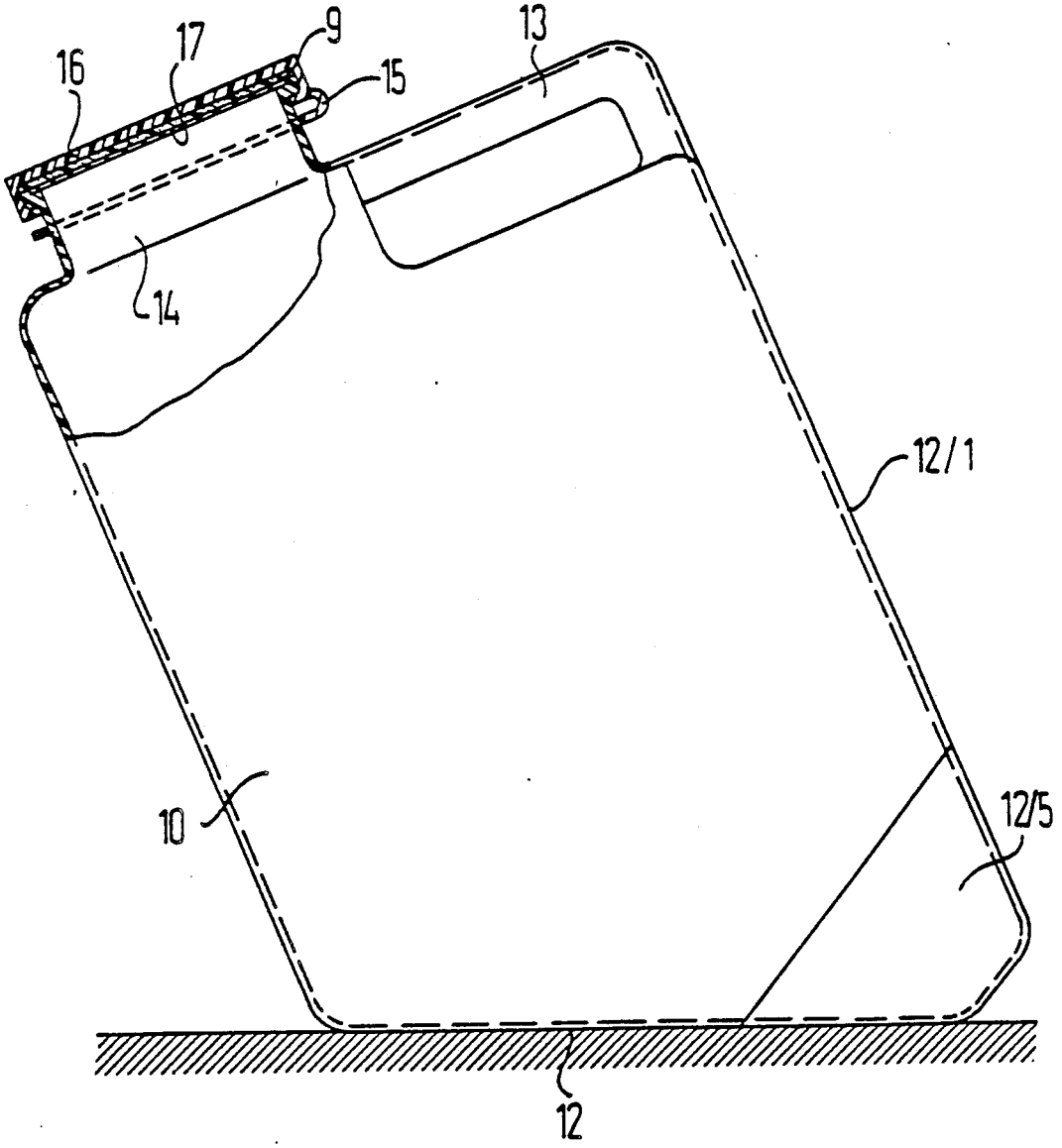
FIG. 2 a schematic sectional view of the toner container.

Collecting region and filling and emptying opening 14 are arranged such relative to one another that, according to FIG. 1, a suction nozzle 18 introduced into the toner container from above penetrates up to the collecting region after a corresponding draw-off of the toner powder.

In this characteristic removal position shown in FIG. 1, the collecting region forms the lowest point of the toner container. With reference to the vertical axis A of the introduction or, respectively, removal position of the toner container, the walls thereby describe an angle B that amounts to less than 45°.

In the illustrated emptying position of FIG. 1, this means that all walls have a slant relative to the vertical axis A that prevents toner from remaining adhering to the walls of the container given the removal with the suction nozzle 18 in combination with a beating/shaking means. During emptying, the toner collects in the collecting region formed by the walls 12/5 and 12/6 or, respectively, 12 and 12/1 that forms the lowest location of the container and the toner can be completely suctioned off there.

In order to be able to supply the toner from the toner container 10 to the developer station in functionally reliable fashion without contaminating the environment, the toner delivery region comprises a draw-off means for the toner and comprises a corresponding holding means for the toner container 10.

The draw-off means is thereby composed of the suction nozzle 18 arranged in vertically displaceable fashion between the guide rods (FIG. 3), this suction nozzle 18 being in communication via a flexible suction pipe 20 with a blower of the printer that is not shown here. The blower suctions the toner out of the toner container 10 via the suction nozzle and deposits it in the developer station.

Figure 4:
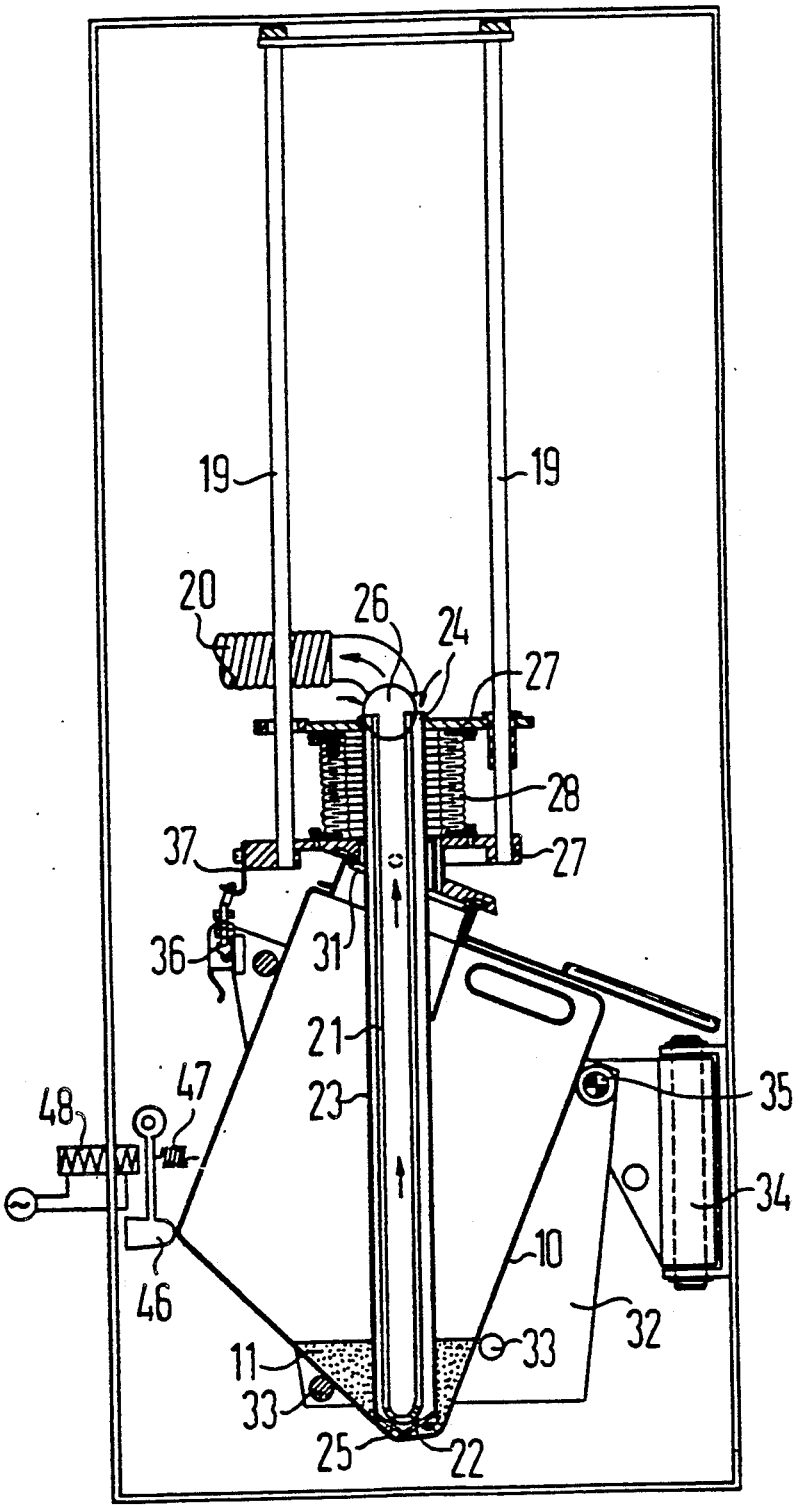
FIG. 4 a schematic sectional view of the toner delivery region of the printer means in a partially sectional view with a nearly completely emptied toner container.

According to FIG. 4, the suction nozzle 18 comprises an inside tube 21 cut wedge-like at its bottom end that is in communication with the flexible suction tube 20 and comprises draw-in openings 22 for the toner. The inside tube 21 is completely surrounded by an outside tube 23 arranged at a distance therefrom that, first, comprises an air intake opening 24 at its upper part that opens into the environment and, second, comprises toner entry openings 25 at its tip in the take-in region. The spacing and the guidance of the inside tube 21 are effected by spacer elements (not shown here) that, for example, can be composed of three strips of expanded cellular material uniformly distributed over the circumference.

In order to keep lumpy toner residues away from the delivery to the printer station, the toner entry openings 25 can be covered by a toner sieve that covers the take-in region of the suction nozzle.

Figure 5A:
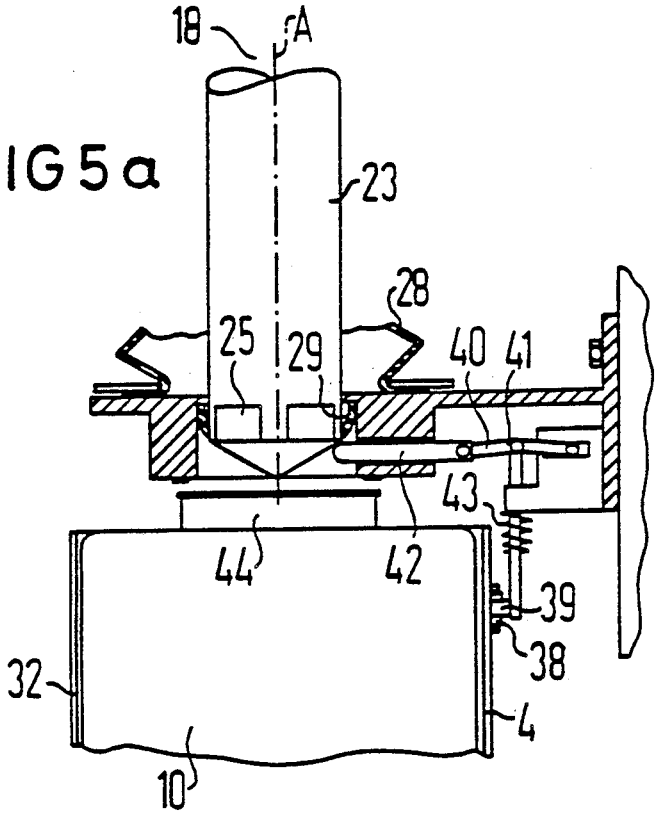
FIGS. 5*a* and 5*b* a sectional view of the safety mechanism for the suction nozzle in its secured condition.
Figure 5B:
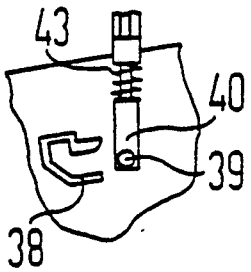
Figure 6A:
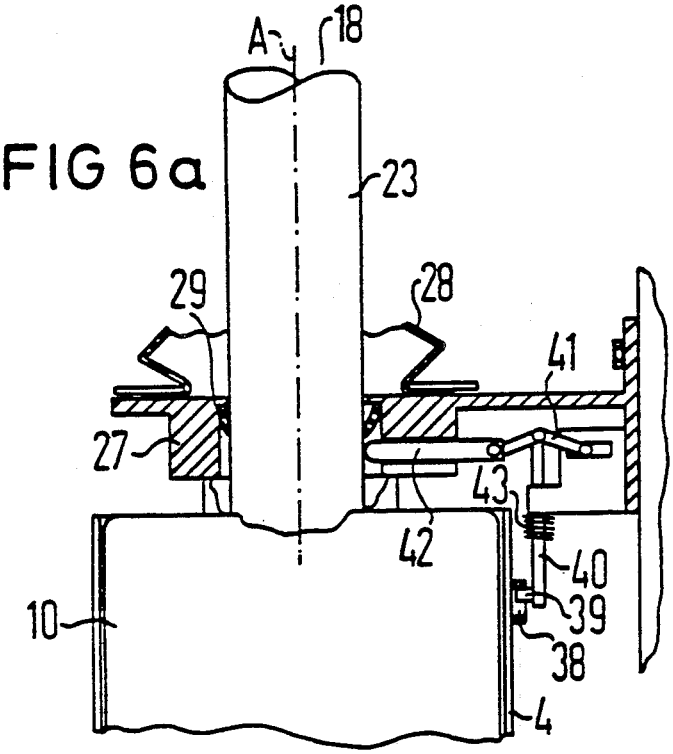
FIGS. 6*a* and 6*b* a sectional view of the safety mechanism for the suction nozzle in its unsecured condition.
Figure 6B:
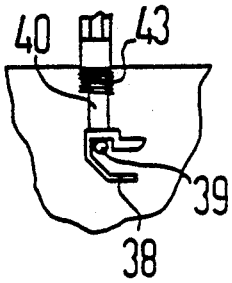

The suction nozzle itself is arranged in vertically displaceable fashion via a handle 26. Carrier elements 27 are provided to this end that guide the suction nozzle between guide rods 19. In order to protect the suction nozzle and in order to prevent an emergence of toner into the environment, the suction nozzle 18 is surrounded by a sheath in the form of a rubber accordion bellows 28. This sheath 28 is secured to the carrier elements 27 at the top and bottom, whereby the lower carrier element 27 is fashioned as an adaptor for connecting the toner container 10 and as a lower guide for the suction nozzle 18. The adaptor is thereby stationarily arranged and contains an annular stripper ring 29 (FIG. 7) for stripping toner residues from the suction nozzle 18; further, a safety means fashioned according to FIGS. 5 and 6 is also provided, this to be set forth later. The actual connector part for the toner container is composed of a sealing ring 30 (FIG. 3) of expanded cellular material for the filling and emptying opening and of a cutting ring 31 that has the job of cutting through the foil 17 when the toner container 10 is introduced.

Further, the receptacle means contains a receptacle container 32 (FIGS. 3 and 4) for the toner container that comprises two wall surfaces between which retaining rods 33 for the toner container are arranged. The receptacle container 32 is pivotably secured to a rotary hinge 34, wherewith the receptacle container 32 can be pivoted out of the interior of the receptacle region (device compartment) of the printer.

The receptacle container 32 is also vertically pivotable around the fastening axis 35 at the rotary hinge 34 and comprising a clamp mechanism 36 that interacts with a corresponding hook 37 at the adaptor of the draw-off devices.

According to FIGS. *5a*, *5b*, *6a*, and *6b* a catch nose 38 is located in a side wall of the receptacle container 32, this catch nose 38 interacting with a corresponding pin 39 of a lifter rod 40 that is resiliently seated in the adaptor. The lifter rod 40 seated in the adaptor is in communication via a toggle lever 14 with a retaining pin 42 secured therein A spring 43 encircles the lifter rod 40.

The function of the described apparatus is then as follows: the toner container 10 comprising foil seal 17 and hinged-open cover 16 is swivelled into the inside of the receptacle region of the printer in the receptacle container 32, being swivelled via the rotary hinge 34. By turning around the fastening axis 35, a clamp mechanism 36 brings the toner container 10 arranged in the receptacle container 32 into engagement with the adaptor. Before, however, the neck 44 of the toner bottle engages into the sealing ring 30 of expanded cellular material, a circular sector of about 340° is cut into the foil seal by the cutting ring 31.

When the neck 44 of the toner bottle engages into the sealing ring 30 of expanded cellular material, the safety mechanism of FIG. 5 and 6 releases the suction nozzle 18. The suction nozzle 18 is fixed by a retaining pin 42 that is connected to the toggle mechanism 41. Due to the swivel motion of the receptacle container 32 around the fastening axis 35, the pin 39 on the lifter rod 40 enters into engagement with the catch nose 38 arranged on the receptacle container and having an appertaining leading bevel. The lifter rod 40 is lifted and the retaining pin 42 moved by the toggle lever 41 releases the suction nozzle 18. As a result of its dead weight, the suction nozzle 18 penetrates into the toner container 10 and thereby presses the slit foil seal 17 that is connected only at a tongue into the interior of the bottle where the actual toner delivery can now begin. The catch nose 38 prevents the receptacle container 32 from being swivelled away when the suction nozzle 18 is introduced.

After the conclusion of the conveying event, i.e. when the toner container 10 is changed, the suction nozzle 18 is drawn from the toner container 10 with the handle 26. The toner adhering to the suction nozzle 18 is removed by the stripper ring 29 when the suction nozzle 18 is withdrawn and falls back into the inside of the bottle. The rubber bellows 28 covers the suction nozzle 18 that may still be slightly contaminated and thus offers protection against accidental contact.

Figure 7:
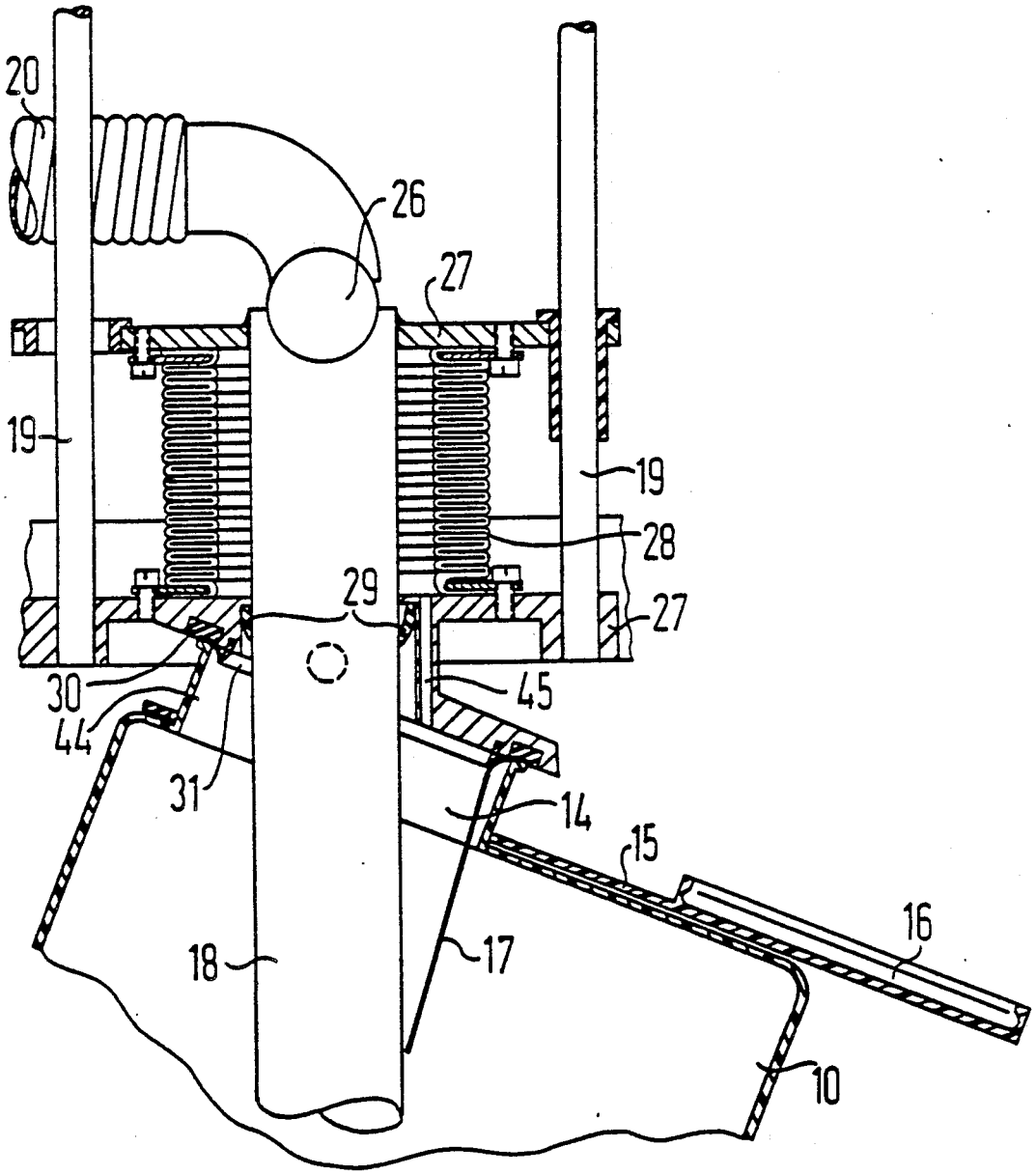
FIG. 7 a schematic sectional view of the adaptor region of the suction means.

Upon compression of the rubber bellows 28, i.e. given penetration into the toner bottle 10, a pressure equalization takes place through a bore 45 (FIG. 7).

When the suction nozzle 18 has been entirely withdrawn from the toner bottle 10, the compression spring 43 can press the lifter rod 40 in downward direction and thereby inhibit the suction nozzle 18 with the retaining pin 42. At the same time, the pin 39 that interacts with the catch nose 38 is released and the receptacle container 32 together with the toner container 10 can be swivelled away.

In order to assure a reliable delivery of the toner 11 into the draw-off region of the suction nozzle 18 when the suction nozzle is introduced, a shaker means can be provided (FIG. 4) in the receptacle region, this shaker means, for example, being composed of a beater hammer 46 that is swivelably arranged in the receptacle means and that can be deflected via an electromagnet 48 opposite a spring power 47. This beater hammer 46 thereby forms a type of shaker means that strips toner that may still be potentially adhering to the inside walls of the toner container 10.

Given printer means operating according to the principle of electrophotography, the residual toner remaining on the photoconductive drum after the transfer event must be conveyed away from the photoconductive drum by a brush cleaning station applied to an underpressure and must be deposited in a collecting container by a cyclonic filter.

Figure 8:
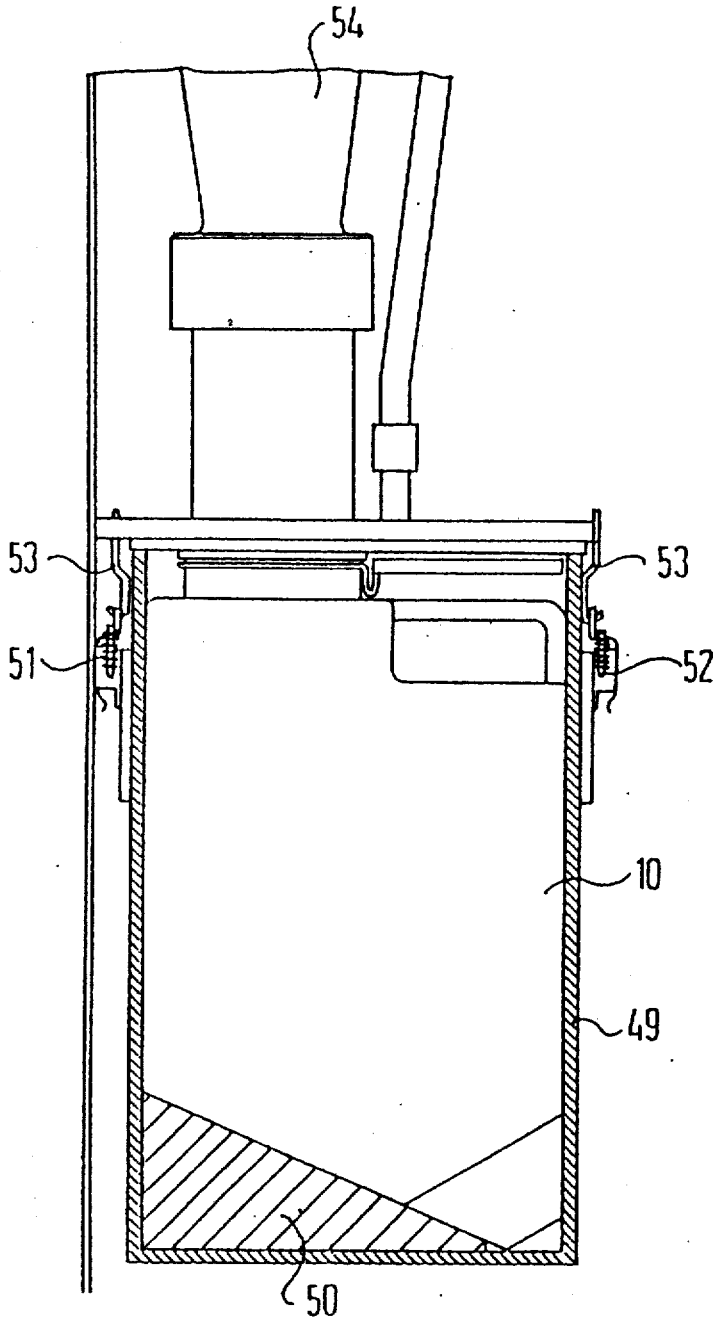
FIG. 8 a schematic illustration of the emptying region of the printer means with inserted toner container as collecting container.

According to FIG. 8, an empty toner container 10 can serve as collecting container for this residual toner. To this end, an empty toner container is inserted into a holding container 49 that comprises a wedge-shaped insert 50 in its bottom region, this insert 50 being shaped to correspond with the bottom supporting surface 12 of the toner container 10. Via appropriate clamp mechanisms 51 and 52, the holding container 49 together with the empty toner container 10 arranged therein can be secured to the hook 53 of the exit pipe 54 of the cyclonic filter (not shown here).

Although other modifications and changes may be suggested by those skilled in the art, it is the intention of the inventors to embody within the patent warranted hereon all changes and modifications as reasonably and properly come within the scope of their contribution to the art.

What is claimed is:

1. A toner delivery system for delivering toner to a printer or copier means, comprising: a toner container having a filling and emptying opening, a holding mechanism of a printer or copier means being interchangeably fastenable to said filling and emptying opening of said toner container to hold said toner container in a toner removal position, a suction nozzle mounted in said printer or copier means and defining a toner passageway into said printer or copier means, said toner container comprises a funnel-shaped floor that forms a lowest collecting region for the toner, the filling and emptying opening and the collecting region are arranged relative to one another such that, when the toner container is fastened in the holding mechanism in the removal position wherein the collecting region forms the lowest region of the toner container, said suction nozzle mounted in the printer or copier device is displaceable into the collecting region; and in that at least one container wall of the toner container is fashioned as a supporting surface for the toner container.

2. A toner delivery system according to claim 1, wherein all container walls of said toner container are substantially planar surfaces.

3. A toner delivery system according to claim 1, wherein said toner container comprises container walls disposed at a slant in order to facilitate flow of the toner to said collecting region of said toner container, said container walls describing an angle with reference to a vertical axis of the toner container in the removal position of less than 45 degrees.

4. A toner delivery system according to claim 1, wherein said holding mechanism further comprises a shaker mechanism operable to shake said toner container when said toner container is fastened to said holding mechanism.

5. A toner delivery system according to claim 1, wherein said holding mechanism further comprises a means for swivelably inserting the container into the printer or copier means.

6. A toner delivery system according to claim 1, further comprising: a flexible protective sheath about said suction nozzle to permit vertical displacement of said suction nozzle within said sheath, a guide means for guiding said suction nozzle during vertical displacement, said guide means being arranged above the holding mechanism, whereby the suction nozzle gravitationally displaces itself along said guide means in accord with the level of toner in the toner container during draw-off.

7. A toner delivery system according to claim 6, further comprising: an adapter between said guide means and said holding mechanism that connects the flexible protective sheath to said filling and emptying opening of the toner container in dust-tight fashion.

8. A toner delivery system according to claim 7, wherein said toner container has a foil covering said filling and emptying opening when said toner container is in a filled condition, and further comprising: a cutting means for penetrating said foil that covers the filling and emptying opening of the toner container in its filled condition.

9. A toner delivery system according to claim 1, further comprising: a gripper element on said toner container by which said toner container is gripped.

10. A toner delivery system according to claim 1, further comprising: a closing cover fastened in captive fashion to the filling and emptying opening.

* * * * *

UNITED STATES PATENT AND TRADEMARK OFFICE

CERTIFICATE OF CORRECTION

PATENT NO. : 4,990,964

DATED : February 5, 1991

INVENTOR(S) : Erich Kraehn

It is certified that error appears in the above-indentified patent and that said Letters Patent is hereby corrected as shown below:

IN THE DRAWINGS: After FIG. 7, FIG. 8 is added as shown by the attached copy of FIG. 8

Signed and Sealed this

Seventh Day of April, 1998

Bruce Lehman

*Attest:*

BRUCE LEHMAN

*Attesting Officer*

*Commissioner of Patents and Trademarks*